US011827433B1

(12) United States Patent
Sood

(10) Patent No.: US 11,827,433 B1
(45) Date of Patent: Nov. 28, 2023

(54) CHILD-RESISTANT CAP AND A METHOD TO OPERATE THE SAME

(71) Applicant: SOOD PLASTICS PRIVATE LIMITED, Rajpura (IN)

(72) Inventor: Anmol Sood, Rajpura (IN)

(73) Assignee: SOOD PLASTICS PRIVATE LIMITED

( * ) Notice: Subject to any disclaimer, the term of this patent is extended or adjusted under 35 U.S.C. 154(b) by 0 days.

(21) Appl. No.: 18/301,567

(22) Filed: Apr. 17, 2023

(51) Int. Cl.
*B65D 50/04* (2006.01)
*B65D 51/24* (2006.01)

(52) U.S. Cl.
CPC ..... *B65D 50/043* (2013.01); *B65D 51/245* (2013.01)

(58) Field of Classification Search
CPC .... B65D 51/18; B65D 50/041; B65D 50/043; B65D 51/245
USPC ..... 215/206
See application file for complete search history.

(56) References Cited

U.S. PATENT DOCUMENTS 3,795,338 A * 3/1974 Swartzbaugh ..... B65D 50/041 215/301
3,797,688 A * 3/1974 Porcelli ..... B65D 50/041 215/220
5,280,842 A * 1/1994 Koo ..... B65D 50/041 215/220
8,316,622 B2 11/2012 Jajoo et al.
11,396,409 B1 * 7/2022 Lempert ..... B65D 50/041
11,406,804 B2 * 8/2022 Uetsuki ..... B65D 50/041
2010/0313527 A1 * 12/2010 Jajoo ..... B65D 50/041 215/220
2011/0139742 A1 * 6/2011 Brozell ..... B65D 50/041 215/220
2012/0085725 A1 4/2012 Parekh et al.
2012/0138561 A1 * 6/2012 Brozell ..... B65D 50/041 215/220
2018/0208370 A1 * 7/2018 Faragher ..... B65D 50/041
(Continued)

FOREIGN PATENT DOCUMENTS

EP 3743351 A1 12/2020
GB 2138410 A * 10/1984 ..... B65D 50/041
(Continued)

OTHER PUBLICATIONS

How do Child Proof Caps work; https://www.youtube.com/watch?v=EG8XTxus-Tw.

*Primary Examiner* — J. Gregory Pickett
*Assistant Examiner* — Niki M Eloshway
(74) *Attorney, Agent, or Firm* — Jason C. Cameron

(57) ABSTRACT

A child-resistant cap for containers is provided. The child-resistant cap includes an outer cap and an inner cap. The outer cap is configured with a knurled side wall and includes a plurality of inner projections and a plurality of involute teeth projected on an inner top surface. The inner cap is configured to fit into the outer cap and includes an inner side wall which includes a plurality of ribs positioned on the outer side. The space between the adjacent ribs of the plurality of ribs includes an inclined structure and a plurality of undercuts. An outer top surface of the inner cap includes a plurality of projections with a wedge-shaped structure which is configured to mesh with the plurality of involute teeth. The wedge-shaped structure includes a chamfered edge. A bottom surface of the inner cap is configured as a tapered surface.

8 Claims, 7 Drawing Sheets

(56) References Cited

U.S. PATENT DOCUMENTS

| | | | | |
|---|---|---|---|---|
| 2019/0276202 | A1* | 9/2019 | Wilson | B65D 50/043 |
| 2021/0171249 | A1* | 6/2021 | Aboabdo | B65D 1/0246 |

FOREIGN PATENT DOCUMENTS

| | | | | |
|---|---|---|---|---|
| WO | WO-2018127849 | A1 * | 7/2018 | B65D 50/041 |
| WO | WO-2022180567 | A1 * | 9/2022 | |

* cited by examiner

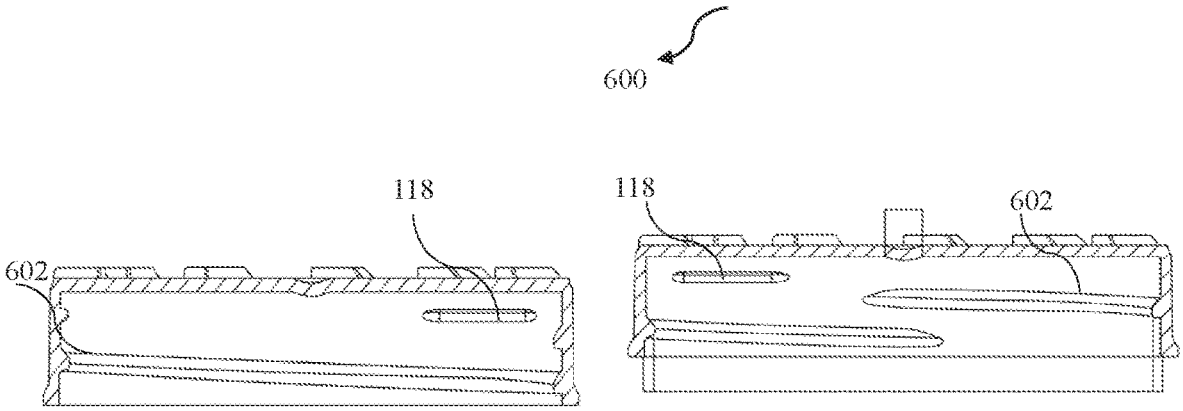
FIG 6a
FIG 6b
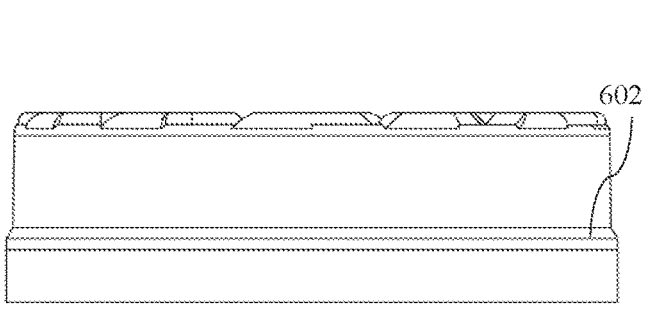
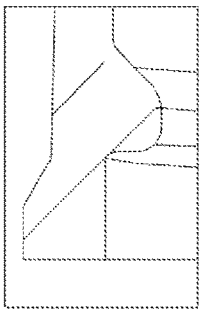
FIG 6c
FIG 6d

CHILD-RESISTANT CAP AND A METHOD TO OPERATE THE SAME

FIELD OF INVENTION

Embodiments of a present disclosure relate to the caps, and more particularly to a child resistant cap and a method to operate the same.

BACKGROUND

A container is used to store goods (for instance, papers, food, medicines, juices, and the like) and is typically closed with a cap, cover, lid or the like. It is desirable that the container is specifically when it encloses medicines and other liquids that may spill out of the container if the cap is not secured properly on the container. Also, it is desirable that the cap of the container is child-resistant so as to avoid undesirable accidents with children.

The existing container caps are easy to open, which is harmful when it is easily reached by children. Children may open the cap and may accidentally consume the hazardous components enclosed in the container. Additionally, the currently existing caps include a locking mechanism. However, it is hard to operate the said. Further, such caps are child resistant but are not senior citizen friendly. Consequently, the senior citizen may find it challenging to open such containers with child-resistant caps.

Thus, there is a need to provide caps that is child-resistant and easy to open and close by senior citizens. Further, there is a need to provide a child-resistant caps of the container that are used for medicinal purposes.

Hence, there is a need for a child-resistant cap which addresses the aforementioned issues.

BRIEF DESCRIPTION

In accordance with one embodiment of the disclosure, a child-resistant cap for containers is provided. The child-resistant cap includes an outer cap and an inner cap. The outer cap is configured with a knurled side wall. The outer cap includes a plurality of inner projections and is positioned on an inner surface of the knurled side wall. The plurality of inner projections is semi-cylindrical in shape. a plurality of involute teeth projected on an inner top surface, wherein the plurality of involute teeth is placed equidistantly to each other. The inner cap is operatively coupled with the outer cap, wherein the inner cap is configured to fit into the outer cap. The inner cap includes an inner side wall. The inner side wall includes a plurality of ribs and a plurality of undercuts. The plurality of ribs is positioned on an outer side of the inner side wall and an outer top surface. The space between the adjacent ribs of the plurality of ribs comprises an inclined structure, wherein the plurality of ribs is configured to lock the inner side wall and the inner surface of the knurled side wall creating an interlock. A plurality of undercuts is positioned on the inner side of the inner side wall, wherein the plurality of undercuts enables the outer cap to rotate in a locked position. The outer top surface is operatively coupled to the side wall, wherein the outer top surface comprises a plurality of projections positioned equidistantly on a top portion of the outer top surface with a predefined gap between each of the adjacent projections of the plurality of projections. The plurality of projections is configured with a wedge-shaped structure. The wedge-shaped structure is configured to mesh with the plurality of involute teeth. The wedge-shaped structure comprises a chamfered edge coupled to the top face of the top surface. The bottom surface is configured as a tapered surface enabling the locking of the inner cap in an inoperative position.

In accordance with another embodiment, a method for operating a child-resistant cap for a container is provided. The method includes projecting, a plurality of inner projections of an outer cap positioned on an inner surface of the knurled side wall, wherein the plurality of inner projections is semi-cylindrical in shape. The method also includes placing, a plurality of involute teeth of is placed equidistantly to each other, wherein the plurality of involute teeth is projected on an inner top surface. Further, the method providing, a plurality of ribs positioned on an outer side of the inner side wall wherein the space between the adjacent ribs of the plurality of ribs comprises an inclined structure. Furthermore, the method includes locking, by the plurality ribs, lock the inner side wall and the inner surface of the knurled side wall creating an interlock. Furthermore, the method includes enabling, by a plurality of undercuts, the outer cap to rotate in a locked position. Furthermore, the method includes providing, an outer top surface, a plurality of projections positioned equidistantly on a top portion of the outer top surface with a predefined gap between each of the adjacent projections of the plurality of projections. Furthermore, the method includes meshing, by a wedge-shaped structure of the plurality of projections, with the plurality of involute teeth. Furthermore, the method includes providing, chamfered edge coupled to the top face of the top surface. Furthermore, the method includes enabling, by a bottom surface with a tapered surface, the locking of the inner cap in an inoperative position.

To further clarify the advantages and features of the present disclosure, a more particular description of the disclosure will follow by reference to specific embodiments thereof, which are illustrated in the appended figures. It is to be appreciated that these figures depict only typical embodiments of the disclosure and are therefore not to be considered limiting in scope. The disclosure will be described and explained with additional specificity and detail with the appended figures.

BRIEF DESCRIPTION OF THE DRAWINGS

The disclosure will be described and explained with additional specificity and detail with the accompanying figures in which:

FIG. 6*a* is a perspective view of a plurality of undercuts and the thread of the inner cap of FIG. 1*b* in accordance with an embodiment of the present disclosure;

FIG. 6*b* is a perspective view of a plurality of undercuts and the thread of FIG. 1*b* in accordance with another embodiment of the present disclosure;

FIG. 6*c* is a perspective view of the thread of the inner cap of FIG. 1*b* in accordance with yet another embodiment of the present disclosure.

FIG. 6*d* is a perspective view of a thread pitch of the inner cap of FIG. 1*b* in accordance with an embodiment of the present disclosure;

Figure 1A:
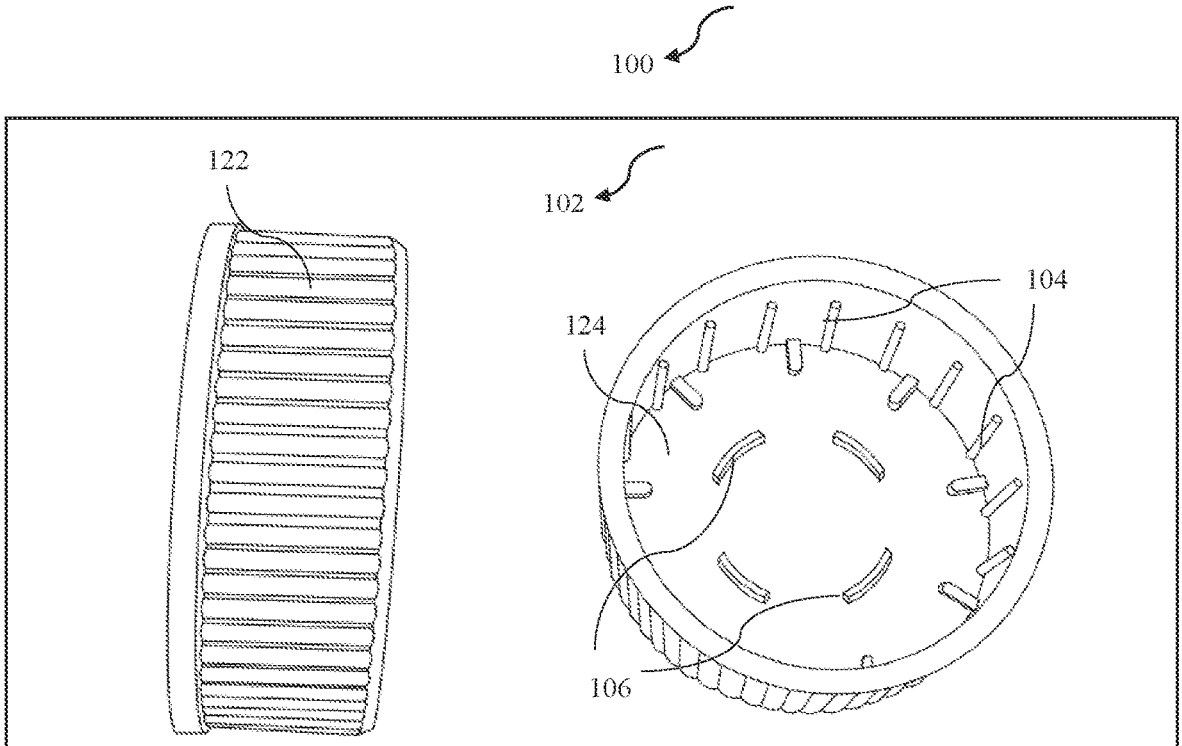
FIG. 1*a* is a schematic representation of an outer cap of a child-resistant cap in accordance with an embodiment of the present disclosure.

Further, those skilled in the art will appreciate that elements in the figures are illustrated for simplicity and may not have necessarily been drawn to scale. Furthermore, in terms of the construction of the device, one or more components of the device may have been represented in the figures by conventional symbols, and the figures may show only those specific details that are pertinent to understanding the embodiments of the present disclosure so as not to obscure the figures with details that will be readily apparent to those skilled in the art having the benefit of the description herein.

DETAILED DESCRIPTION

For the purpose of promoting an understanding of the principles of the disclosure, reference will now be made to the embodiment illustrated in the figures and specific language will be used to describe them. It will nevertheless be understood that no limitation of the scope of the disclosure is thereby intended. Such alterations and further modifications in the illustrated system, and such further applications of the principles of the disclosure as would normally occur to those skilled in the art are to be construed as being within the scope of the present disclosure.

The terms "comprises", "comprising", or any other variations thereof, are intended to cover a non-exclusive inclusion, such that a process or method that comprises a list of steps does not include only those steps but may include other steps not expressly listed or inherent to such a process or method. Similarly, one or more devices or sub-systems or elements or structures or components preceded by "comprises . . . a" does not, without more constraints, preclude the existence of other devices, sub-systems, elements, structures, components, additional devices, additional sub-systems, additional elements, additional structures or additional components. Appearances of the phrase "in an embodiment", "in another embodiment" and similar language throughout this specification may, but not necessarily do, all refer to the same embodiment.

Unless otherwise defined, all technical and scientific terms used herein have the same meaning as commonly understood by those skilled in the art to which this disclosure belongs. The system, methods, and examples provided herein are only illustrative and not intended to be limiting.

In the following specification and the claims, reference will be made to a number of terms, which shall be defined to have the following meanings. The singular forms "a", "an", and "the" include plural references unless the context cl early dictates otherwise.

Embodiments of the present disclosure relate to a child-resistant cap for containers. The child-resistant cap includes an outer cap and an inner cap. The outer cap is configured with a knurled side wall. The outer cap includes a plurality of inner projections and is positioned on an inner surface of the knurled side wall. The plurality of inner projections is semi-cylindrical in shape. A plurality of involute teeth of the outer cap projected on an inner top surface, wherein the plurality of involute teeth is placed equidistantly to each other. The inner cap is operatively coupled with the outer cap, wherein the inner cap is configured to fit into the outer cap. The inner cap includes an inner side wall. The inner side wall includes a plurality of ribs and a plurality of undercuts. The plurality of ribs is positioned on an outer side of the inner side wall and an outer top surface. The space between the adjacent ribs of the plurality of ribs includes an inclined structure, wherein the plurality of ribs is configured to lock the inner side wall and the inner surface of the knurled side wall creating an interlock. A plurality of undercuts is positioned on the inner side of the inner side wall, wherein the plurality of undercuts enables the outer cap to rotate in a locked position. The outer top surface is operatively coupled to the side wall, wherein the outer top surface includes a plurality of projections positioned equidistantly on a top portion of the outer top surface with a predefined gap between each of the adjacent projections of the plurality of projections. The plurality of projections is configured with a wedge-shaped structure. The wedge-shaped structure is configured to mesh with the plurality of involute teeth. The wedge-shaped structure includes a chamfered edge coupled to the top face of the top surface. The bottom surface is configured as a tapered surface enabling the locking of the inner cap in an inoperative position.

The child-resistant cap includes a cap assembly. The cap assembly includes an outer cap 102 and an inner cap 108 affixed to each other. The cap assembly is designed to be a size suitable to fit on a desired container.

Figure 1B:
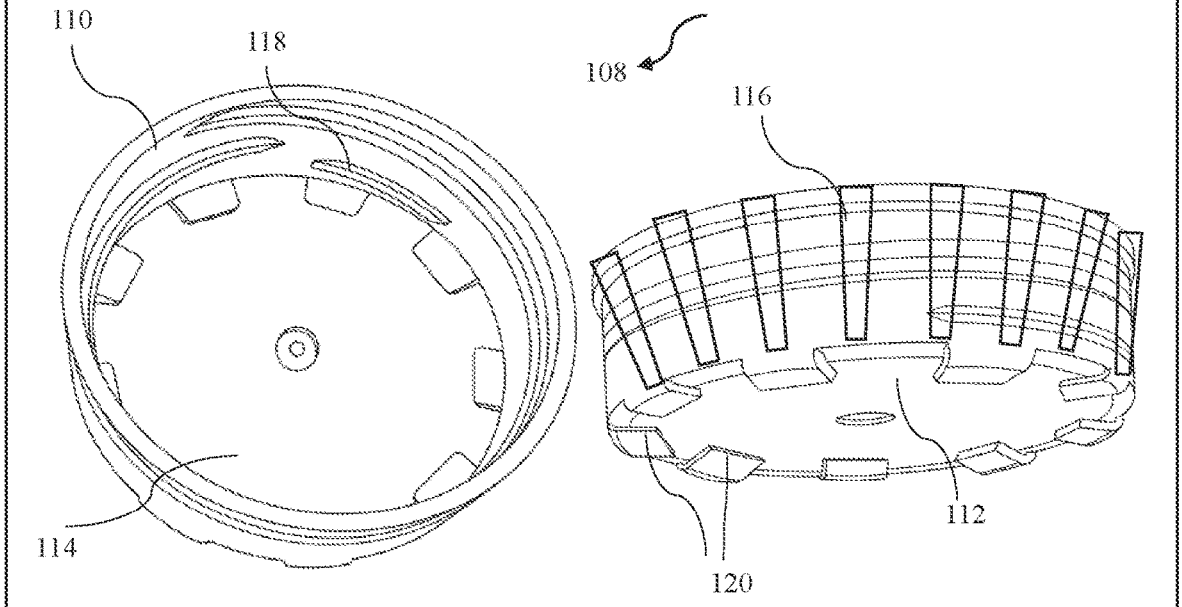
FIG. 1*b* is a schematic representation of an inner cap of a child-resistant cap in accordance with an embodiment of the present disclosure.

FIG. 1*a* is a schematic representation of an outer cap 102 of a child-resistant cap 100 in accordance with an embodiment of the present disclosure and FIG. 1*b* is a schematic representation of an inner cap 108 of a child-resistant cap 100 in accordance with an embodiment of the present disclosure.

The outer cap 102 is configured with a knurled side wall. The outer cap 102 includes a plurality of inner projections 104 and a plurality of involute teeth 106. In one embodiment, the outer cap 102 is configured with a plurality of outer projections 122 arranged on the outer side wall. In one embodiment, the plurality of outer projections 122 may be of semi-cylindrical shape. In another embodiment, the plurality of outer projections 122 enables a smooth feel and grip to the leak proof cap 100.

The plurality of inner projections 104 is positioned on an inner top surface of the knurled side wall. The plurality of inner projections 104 is semi-cylindrical in shape. The plurality of involute teeth 106 is projected on an inner top surface 124 of the outer cap 102. The plurality of involute teeth 106 is placed equidistantly to each other. In one embodiment, the plurality of involute teeth 106 are arc shaped and is positioned at an angle of 55-degree.

The inner cap 108 is operatively coupled with the outer cap 102, wherein the inner cap 108 is configured to fit into the outer cap 102. The inner cap 108 includes an inner side wall 110, an outer top surface 112, and a bottom surface 114. In one embodiment, the inner cap 108 is hollow and circular-shaped in structure.

The inner side wall 110 includes a plurality of ribs 116 and a plurality of undercuts 118. The plurality of ribs 116 is positioned on an outer side of the inner side wall 110. The space between the adjacent ribs of the plurality of ribs 116 includes an inclined structure. The plurality of ribs 116 is configured to lock the inner side wall 110 and the inner surface of the knurled side wall thereby creating an interlock. In one embodiment, the plurality of ribs 116 is positioned equidistantly on the outer side of the inner side wall 110. The plurality of undercuts 118 is positioned on the inner side of the inner side wall 110. The plurality of undercuts 118 enables the outer cap 102 to rotate in a locked position.

The outer top surface 112 of the inner cap 108 is operatively coupled to the side wall. The outer top 112 surface includes a plurality of projections 120 positioned equidistantly on a top portion of the outer top surface 112 with a predefined gap between each of the adjacent projections of the plurality of projections 120. The plurality of projections 120 is configured with a wedge-shaped structure (shown in FIG. 5*b*). The wedge-shaped structure is configured to mesh with the plurality of involute teeth 106. The wedge-shaped structure includes a chamfered edge coupled to the top face of the outer top surface 112.

The bottom surface 114 of the inner cap 108 is configured as a tapered surface enabling the locking of the inner cap in an inoperative position. In one embodiment, the locking of the outer cap 102 and the inter cap 108 creates a distance between the inner top surface 124 of the outer cap 102 and the outer top surface 112 of the inner cap 108, wherein the distance allows the outer cap 102 to rotate while the inner cap 108 is locked.

In one embodiment, the child-resistant cap 100 may be adapted to accommodate multiple sizes. In another embodiment, the child-resistant cap 100 may have a 28 mm diameter of the inner cap 108 and a 32 mm diameter of the outer cap. Also in one embodiment, the child-resistant cap 100 may be able to fit to a container having an opening with a 33 mm diameter. Yet, in one embodiment, the child-resistant cap 100 may have a 38 mm of diameter of the inner cap 108. Further, in one embodiment, the child-resistant cap 100 may have a 53 mm diameter of the inner cap 108.

It will be appreciated to those skilled in the art that the outer cap 102 and the inner cap 108 in a closed position, forms an air-tight, child-resistant seal.

Figure 2A:
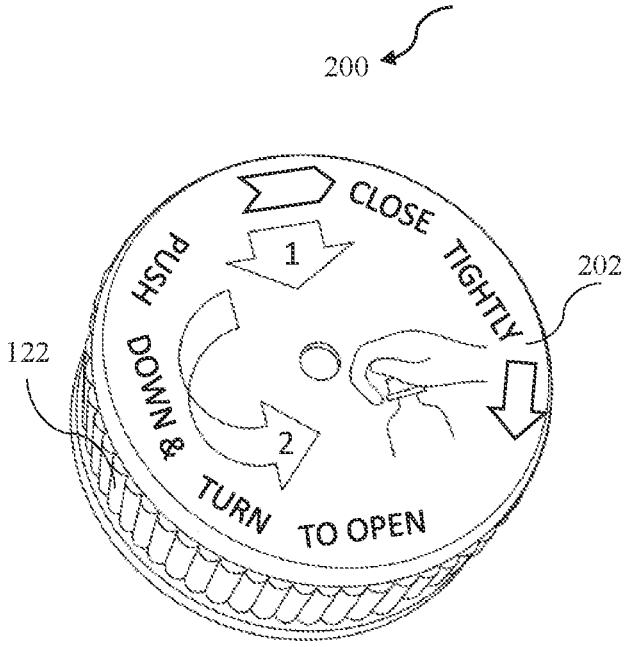
FIG. 2*a* is a top view of an outer top portion of the outer cap of FIG. 1*a* in accordance with an embodiment of the present disclosure.

FIG. 2*a* is a top view of an outer top portion 202 of the outer cap 102 of FIG. 1*a* in accordance with an embodiment of the present disclosure. In one embodiment, the outer cap 102 is hollow and circular-shaped in structure. In another embodiment, the outer cap 102 includes a plurality of arc-shaped projections 126 positioned at the inner top surface. Yet, in one embodiment, the outer cap 102 is pushed and rotated in clockwise direction for unlocking the inner cap 108 from the container. In one embodiment, the outer top portion 202 of the outer cap 102 may be processed with matt finishing. In another embodiment, the outer top surface 202 may be embossed with instructions, wherein the instructions provide a guide to a user for opening and closing the child-resistant cap 100. The instructions help senior citizens to easily operate the child-resistant cap. In one embodiment, the text and signs of the instruction guide is raised by a height, for instance, 0.4 mm from the outer top surface 202.

Figure 2B:
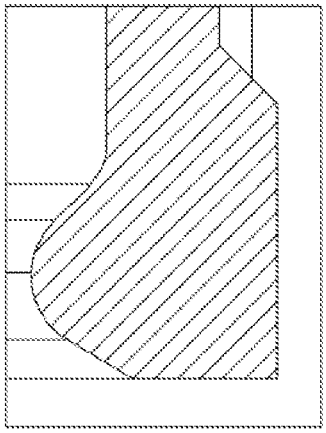
FIG. 2*b* is a schematic view of the thread pitch of the inner cap of FIG. 1*b* in accordance with an embodiment of the present disclosure.

FIG. 2*b* is a schematic view of the thread pitch of the inner cap 108 of FIG. 1*b* in accordance with an embodiment of the present disclosure. In one embodiment, the radius of the arc of the thread pitch is 0.6 mm.

Figure 3A:
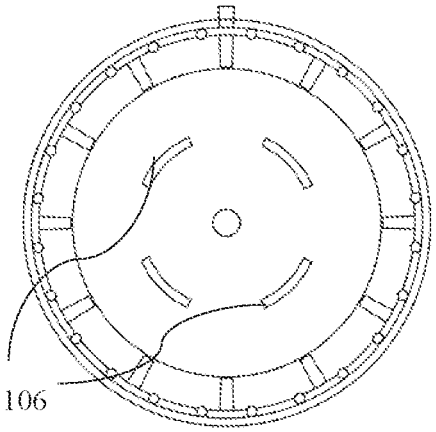
FIG. 3*a* is a top view of the inner portion of the outer cap of FIG. 1*a* in accordance with an embodiment of the present disclosure.

FIG. 3*a* is a top view of the inner portion of the outer cap 102 of FIG. 1*a* in accordance with an embodiment of the present disclosure.

Figure 3B:
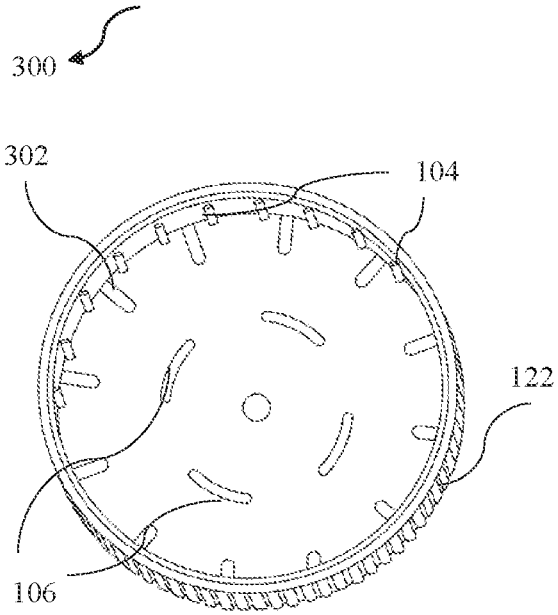
FIG. 3*b* is a perspective view of a plurality of inner projections and a plurality of involute teeth of the outer cap of FIG. 1*a* in accordance with an embodiment of the present disclosure.

FIG. 3*b* is a perspective view of a plurality of inner projections 104, a plurality of outer projection 122 and a plurality of involute teeth 106 of the outer cap of FIG. 1*a* in accordance with an embodiment of the present disclosure. In one embodiment, the plurality of involute teeth 106 and is configured with angled edges 302. In one embodiment, the angle of the edge is 55 degrees.

Figure 4A:
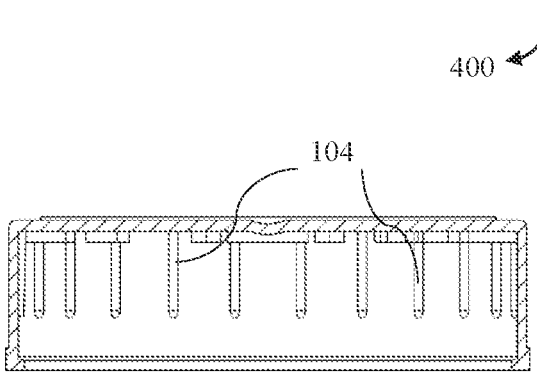
FIG. 4*a* is a perspective view of a plurality of involute teeth of the outer cap of FIG. 1*a* in accordance with an embodiment of the present disclosure.
Figure 4B:
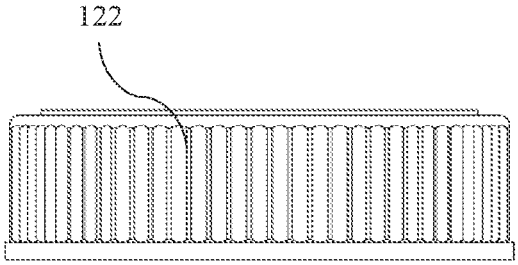
FIG. 4*b* is a side view of the outer cap of FIG. 1*a* in accordance with an embodiment of the present disclosure.

FIG. 4*a* is a cross-sectional view of a plurality of involute teeth 106 of the outer cap 102 of FIG. 1*a* in accordance with an embodiment of the present disclosure. In one embodiment, the plurality of involute teeth 106 are arc-shaped and form a circular shape at the inner side of a top wall. In another embodiment, the diameter of the circular shape is 27 mm. In one embodiment, each inner projection of the plurality of inner projection 104 is 0.9 mm thick. In one embodiment, the thickness of the side wall is 0.1 mm. However, the measurements are not limited to a particular number, the measurements provided are exemplary. FIG. 4*b* is a perspective view of the outer cap 102 of FIG. 1*a* in accordance with an embodiment of the present disclosure. In one embodiment, a side view of the outer cap showing plurality of outer projection 122.

Figure 5A:
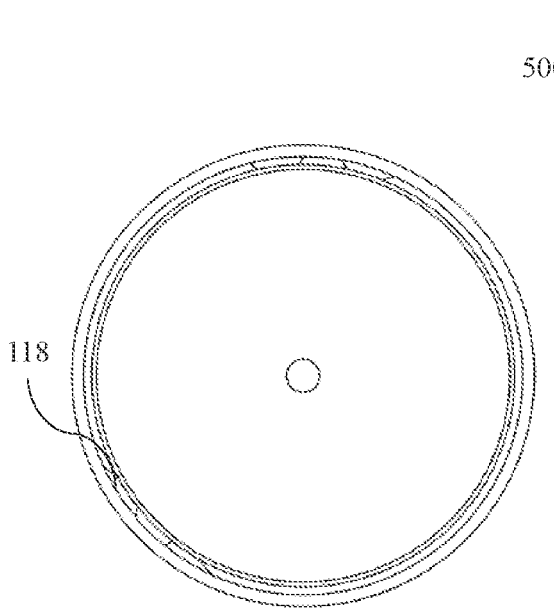
FIG. 5*a* is a side view of the inner cap of FIG. 1*b* in accordance embodiment of the present disclosure.

FIG. 5*a* is a side view of the inner cap 108 of FIG. 1*b* in accordance with an embodiment of the present disclosure. In one embodiment, the plurality of undercuts 118 is arc-shaped with an angle of 28-degree but not limited to 28-degree.

Figure 5B:
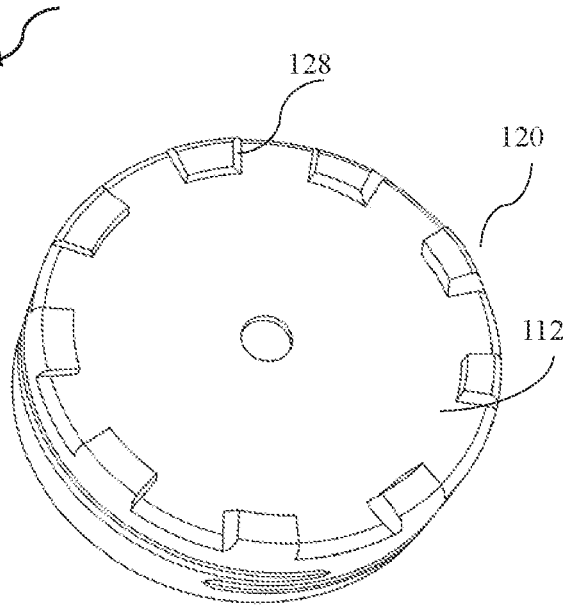
FIG. 5*b* is a top view of the outer top surface of the inner cap of FIG. 1*b* in accordance with an embodiment, of the present disclosure.

FIG. 5*b* is a top view of the outer top surface 112 of the inner cap of FIG. 1*b* in accordance with an embodiment of the present disclosure. The outer top surface 112 includes the plurality of projections 120 positioned equidistantly. In one embodiment, the plurality of projections 120 is configured to fit in the plurality of involute teeth 106 of the outer cap 102.

Figure 5C:
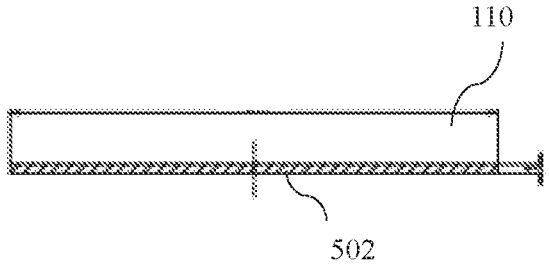
FIG. 5*c* is a side view of a child-resistant material of the inner cap of FIG. 1*b* in accordance with an embodiment of the present disclosure.

FIG. 5*c* is a side view of a child-resistant material 502 of the inner cap 108 of FIG. 1*b* in accordance with an embodiment of the present disclosure. In one embodiment the child-resistant material 502 is a paper gasket. In another embodiment, the child-resistant material 502 prevents an inner liquid substance to leak from the container.

FIG. 6*a* is a perspective view of a plurality of undercuts 118 and the thread 602 of the inner cap 108 of FIG. 1*b* in accordance with an embodiment of the present disclosure. In one embodiment, the thread 602 is arranged continuously along the peripheral area of the inner side of the inner cap 108. In one embodiment, the thread 602 on the inner cap 108 may also be sized and structured to match the threads on the container.

FIG. 6*b* is a perspective view of a plurality of undercuts 118 and the thread 602 of FIG. 1*b* in accordance with another embodiment of the present disclosure. In one embodiment, the thread 602 is arranged partially along the peripheral area of the inner side of the inner cap 108.

FIG. 6*c* is a perspective view of the thread 602 of the inner cap 108 of FIG. 1*b* in accordance with yet another embodiment of the present disclosure. In one embodiment, the thread 602 is arranged angularly along the peripheral area of the inner side of the inner cap 108. In another embodiment, the angle is 30 degrees along the horizontal plane.

FIG. 6*d* is a perspective view of a thread 602 pitch of the inner cap 108 of FIG. 1*b* in accordance with an embodiment of the present disclosure. In one embodiment, the single thread 602 pitch is 4 mm. In one embodiment, the child-resistant cap 100 may be designed to fit on a desired bottle. Also, threads 602 on the inner cap 108 may also be sized and structured to match the threads the container.

Figure 7A:
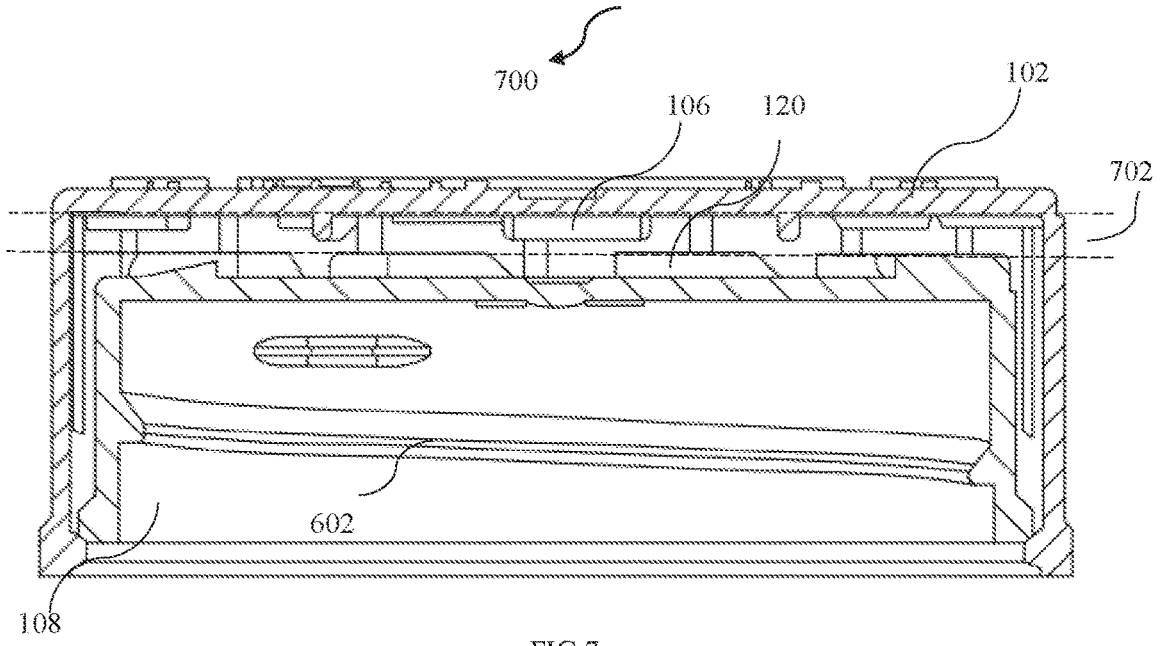
FIG. 7*a* is a perspective view of the inner cap engaged with the outer cap in an operative condition.

FIG. 7*a* is a perspective view of the inner cap 108 engaged with the outer cap 102 in an operative condition. FIG. 7*a* illustrates a gap 702 between the inner cap 108 and the outer cap 102 after engagement as the child-resistant cap is fitted to the container. For closing the child-resistant cap, the plurality of projections 120 of the inner cap 108 is configured to fit in the plurality of involute teeth 106 of the outer cap 102. Then the thread 602 of the inner cap of child-resistant cap 100 is fitted to the thread of the container by rotating the child-resistant cap 100 in clockwise direction. Once the child-resistant cap 100 is fitted to the container, due the gap 702 the plurality of involute teeth slides when the user attempts to open the cap without pushing the cap in a downward direction.

Figure 7B:
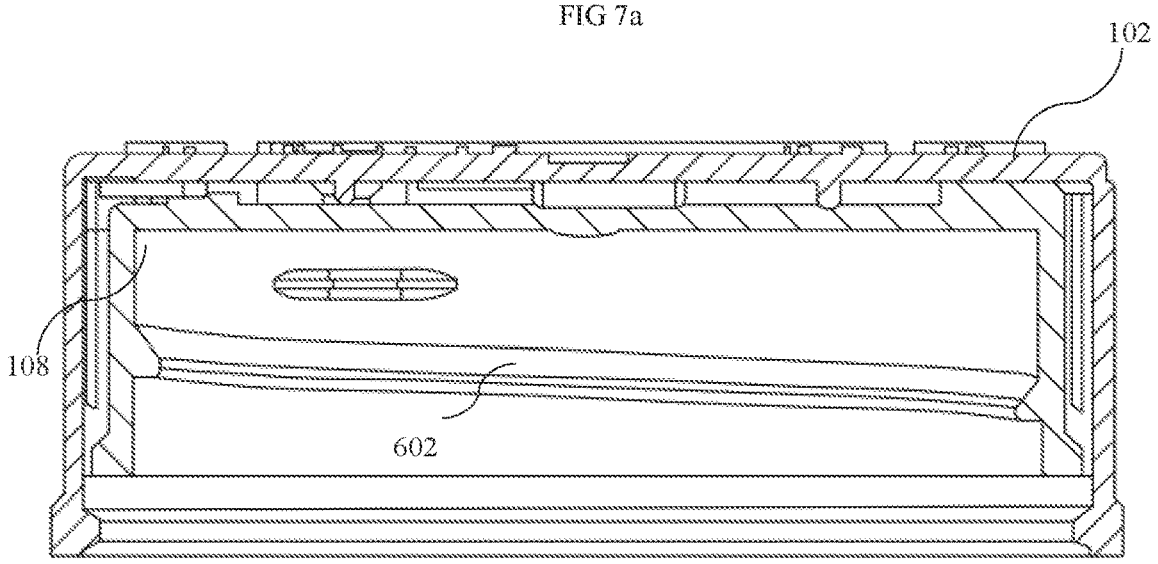
FIG. 7*b* is a perspective view of the inner cap engaged with the outer cap in an inoperative condition.

FIG. 7*b* is a perspective view of the inner cap 108 engaged with the outer cap 102 in an inoperative condition. FIG. 7*b* illustrates that there is no gap between the inner cap 108 and the outer cap 102 after engagement as the outer cap 102 is pushed in downward direction for opening the child-resistant cap from the container. For opening the child-resistant cap 100 is pushed and rotated in an anticlockwise direction. The distance between the inner bottom surface of the outer cap 102 and the outer top surface 112 of the inner cap 108 is reduced by about 1 mm. This reduction in distance enables the inner sidewall 110 of the outer cap 108 and the outer sidewall of the inner cap 108 to engage with each other.

Figure 8:
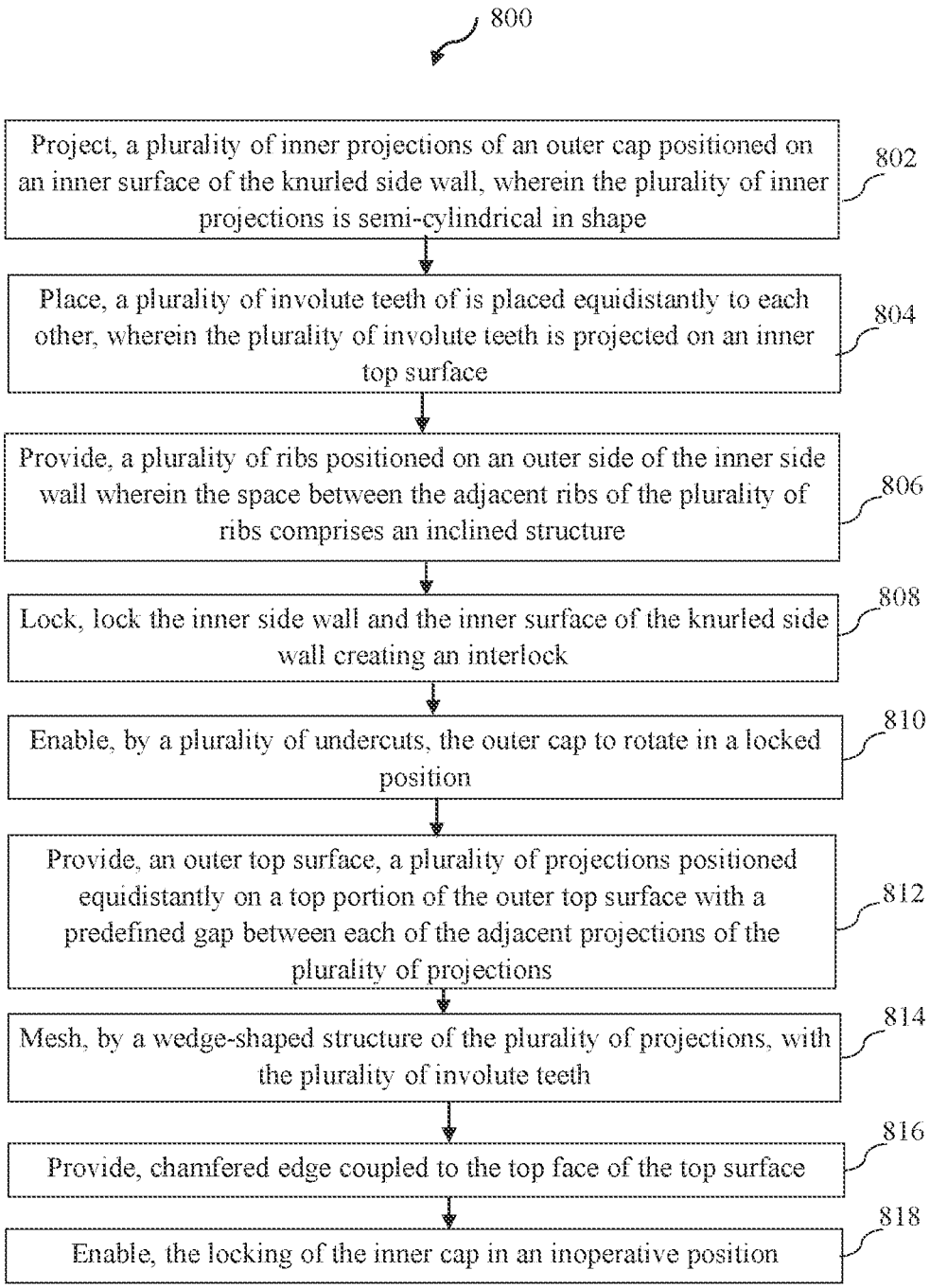
FIG. 8 is a flow chart representing steps involved in a method for the operation of a child-resistant cap for containers in accordance with an embodiment of the present disclosure.

FIG. 8 is a flow chart representing steps involved in a method 800 for the operation of a child-resistant cap for containers in accordance with an embodiment of the present disclosure. The method includes providing, a cap assembly. The method also includes affixing, by the cap assembly, an outer cap and an inner cap to each other. The method also includes designing, the cap assembly to be a size suitable to fit on a desired container.

The method 800 includes projecting, a plurality of inner projections of an outer cap positioned on an inner surface of the knurled side wall, wherein the plurality of inner projections is semi-cylindrical in shape in step 802. The method also includes unlocking, from the container by pushing the outer cap is and rotating for the inner cap.

The method also includes placing, a plurality of involute teeth of is placed equidistantly to each other, wherein the plurality of involute teeth is projected on an inner top surface in step 804. The method also includes providing, a plurality of arc-shaped projections positioned at the inner top surface. The method also includes configuring, the plurality of involute teeth and the wedge-shaped structure with angled edges. The method also includes forming, a circular shape by the plurality of involute teeth is arc-shaped and form at the inner side of a top wall. In another embodiment, the diameter of the inner cap is designed to be fitted to a suitable container.

Further, the method includes providing, a plurality of ribs positioned on an outer side of the inner side wall wherein the space between the adjacent ribs of the plurality of ribs includes an inclined structure in step 806. The method also includes positioning, the plurality of ribs equidistantly on the outer side of the inner side wall.

Furthermore, the method includes locking, by the plurality ribs, lock the inner side wall and the inner surface of the knurled side wall creating an interlock in step 808. The method also includes providing, a predefined thread arranged on the inner side of the wall, where the thread is configured to couple with a container in an operative position. The method also includes arranging, the thread continuously along the peripheral area of the inner side of the inner cap. The method includes providing, the thread on the inner cap structured to match the threads on the container.

Furthermore, the method includes enabling, by a plurality of undercuts, the outer cap to rotate in a locked position in step 810. The method also includes fuming, arc-shaped by the plurality of undercuts with a suitable angle so as to be fitted into the outer cap.

Furthermore, the method includes providing, an outer top surface, a plurality of projections positioned equidistantly on a top portion of the outer top surface with a predefined gap between each of the adjacent projections of the plurality of projections in step 812. The method also includes providing, an outer top surface, wherein the outer top surface includes instructions for a user to open the locked cap.

Furthermore, the method includes meshing, by a wedge-shaped structure of the plurality of projections, with the plurality of involute teeth in step 814.

Furthermore, the method includes providing, chamfered edge coupled to the top face of the top surface in step 816.

Furthermore, the method includes enabling, by a bottom surface with a tapered surface, the locking of the inner cap in an inoperative position in step 818. The method also includes locking, the outer cap and the inter cap and creating a distance between the inner top surface of the outer cap and the outer top surface of the inner cap, wherein the distance allows the outer cap to rotate while the inner cap is locked.

Furthermore, the method includes locking of the outer cap and the inter cap creates a distance between the inner top surface of the outer cap and the outer top surface of the inner cap, wherein the distance allows the outer cap to rotate while the inner cap is locked.

Various embodiments of the present disclosure provide a child-resistant cap for containers. The existing container caps are easy to open, which is harmful to small children. The present disclosure provides a child-resistant cap for containers like medicinal bottles. Also, the currently existing caps which have a locking mechanism, are hard to operate. The leak-proof cap disclosed in the present disclosure is easy to operate.

While specific language has been used to describe the disclosure, any limitations arising on account of the same are not intended. As would be apparent to a person skilled in the art, various working modifications may be made to the method in order to implement the inventive concept as taught herein.

The figures and the foregoing description give examples of embodiments. Those skilled in the art will appreciate that one or more of the described elements may well be combined into a single functional element. Alternatively, certain elements may be split into multiple functional elements. Elements from one embodiment may be added to another embodiment. For example, order of processes described herein may be changed and are not limited to the manner described herein. Moreover, the actions of any flow diagram need not be implemented in the order shown; nor do all of the acts need to be necessarily performed. Also, those acts that are not dependent on other acts may be performed in parallel with the other acts. The scope of embodiments is by no means limited by these specific examples.

I claim:

1. A child-resistant cap for containers comprises:

a cap assembly comprising:

an outer cap configured with a knurled side wall, wherein the outer cap comprises:

a plurality of inner projections positioned on an inner surface of the knurled side wall, wherein the plurality of inner projections is semi-cylindrical in shape; and a plurality of involute teeth projected on an inner top surface, wherein the plurality of involute teeth is arc shaped and placed equidistantly to each other; and an inner cap operatively coupled with the outer cap, wherein the inner cap is configured to fit into the outer cap, wherein the inner cap comprises:

an inner side wall comprising:

a plurality of ribs positioned on an outer side of the inner side wall wherein the space between the adjacent ribs of the plurality of ribs comprises an inclined structure, and wherein the plurality of ribs is configured to lock the inner side wall and the inner surface of the knurled side wall creating an interlock;

a plurality of undercuts positioned on the inner side of the inner side wall, wherein the plurality of undercuts enables the outer cap to rotate in a locked position; and an outer top surface operatively coupled to the inner side wall, wherein the outer top surface comprises a plurality of projections positioned equidistantly on a top portion of the outer top surface with a predefined gap between each of the adjacent projections of the plurality of projections, wherein the plurality of projections is configured with a wedge-shaped structure;

wherein the wedge-shaped structure is configured to mesh with the plurality of involute teeth and are configured with angled edges, wherein the wedge-shaped structure comprises a chamfered edge coupled to the top face of the top surface; and a bottom surface is configured as a tapered surface enabling the locking of the inner cap in an inoperative position, wherein locking of the outer cap and the inter cap creates a distance between the inner top surface of the outer cap and the outer top surface of the inner cap, wherein the distance allows the outer cap to rotate while the inner cap is locked and slides the plurality of involute teeth when a user attempts to open the cap without pushing the cap in a downward direction.

2. The child-resistant cap of claim 1, wherein the outer cap is hollow and circular shaped in structure.

3. The child-resistant cap of claim 1, wherein the outer cap is pushed and rotated for unlocking the inner cap from the container.

4. The child-resistant cap of claim 1, wherein the outer cap comprises an outer top surface, wherein the outer top surface comprises instructions for a user to open the locked cap.

5. The child-resistant cap of claim 1, wherein the inner cap is hollow and circular shaped in structure.

6. The child-resistant cap of claim 1, wherein the inner side wall comprises a predefined thread arranged on the inner side of the wall, where the thread is configured to couple with a container in an operative position.

7. The child-resistant cap of claim 1, wherein the plurality of ribs is equidistantly positioned on the outer side of the inner side wall.

8. A method for operating the child-resistant cap for containers comprises:

projecting, a plurality of inner projections of an outer cap positioned on an inner surface of the knurled side wall, wherein the plurality of inner projections is semi-cylindrical in shape;

placing, a plurality of involute teeth of is placed equidistantly to each other, wherein the plurality of involute teeth is arch shaped and projected on an inner top surface;

providing, a plurality of ribs positioned on an outer side of the inner side wall wherein the space between the adjacent ribs of the plurality of ribs comprises an inclined structure;

locking, by the plurality ribs, lock the inner side wall and the inner surface of the knurled side wall creating an interlock;

enabling, by a plurality of undercuts, the outer cap to rotate in a locked position;

providing, by an outer top surface, a plurality of projections positioned equidistantly on a top portion of the outer top surface with a predefined gap between each of the adjacent projections of the plurality of projections;

meshing, by a wedge-shaped structure of the plurality of projections, with the plurality of involute teeth and are configured with angled edges;

providing, chamfered edge coupled to the top face of the top surface; and enabling, by a bottom surface, with a tapered surface, the locking of the inner cap in an inoperative position, wherein locking of the outer cap and the inter cap creates a distance between the inner top surface of the outer cap and the outer top surface of the inner cap, wherein the distance allows the outer cap to rotate while the inner cap is locked and slides the plurality of involute teeth when a user attempts to open the cap without pushing the cap in a downward direction.

* * * * *